United States Patent [19]

Koppers et al.

[11] 4,142,449

[45] Mar. 6, 1979

[54] HYDRAULIC MINE PROP

[75] Inventors: Manfred Koppers; Otto Dombrowski, both of Duisburg, Fed. Rep. of Germany

[73] Assignee: Thyssen Industrie AG, Fed. Rep. of Germany

[21] Appl. No.: 761,017

[22] Filed: Jan. 21, 1977

[30] Foreign Application Priority Data

Feb. 3, 1976 [DE] Fed. Rep. of Germany ..... 2603987

[51] Int. Cl.[2] ..... E21D 15/44; F15B 13/042

[52] U.S. Cl. ..... 91/468; 248/354 H

[58] Field of Search ..... 91/468, 451; 137/540; 248/354 H

[56] References Cited

U.S. PATENT DOCUMENTS

| | | | |
|---|---|---|---|
| 2,474,464 | 6/1949 | Cable | 248/354 H |
| 2,940,472 | 6/1960 | Chilcoat | 137/540 |
| 2,985,418 | 5/1961 | Tebb et al. | 248/354 H |
| 3,172,340 | 3/1965 | Blenkle | 248/354 H |

FOREIGN PATENT DOCUMENTS

| | | | |
|---|---|---|---|
| 1166126 | 3/1964 | Fed. Rep. of Germany | 248/354 H |
| 720361 | 12/1954 | United Kingdom | 248/354 H |
| 774470 | 5/1957 | United Kingdom | 248/354 H |
| 778715 | 7/1957 | United Kingdom | 248/354 H |

*Primary Examiner*—Irwin C. Cohen
*Attorney, Agent, or Firm*—McGlew and Tuttle

[57] ABSTRACT

A hydraulic mine prop comprises a cylindrical top ram portion and a bottom ram portion which is telescopically engageable in said top ram portion and has an upper piston portion in sliding sealing engagement with the interior of said top ram portion. A ram head closes the top of said ram portion and a valve seat body is disposed between the ram head at a spaced location therefrom adjacent the top of the top ram portion and defines a vent space therebetween. The valve seat body also encloses a pressure space between itself and the piston and a passage is defined through the valve body within a valve seat portion thereof which communicates the pressure space to the vent space. The passage is closed by a spring-biased valve which may open against the biasing force of the spring. The construction includes one or more passages extending through the valve seat and through various generally radially extending passages defined in the body from the pressure space to the vent space and additional passages which are defined outwardly from the vent space to the atmosphere. The construction also includes a ring around the top ram portion having an annular passage which is communicatable through a port or bore of the top ram portion cylinder to a pressure holding valve space which is closable by a rotatable globe valve.

1 Claim, 2 Drawing Figures

HYDRAULIC MINE PROP

FIELD AND BACKGROUND OF THE INVENTION

This invention relates in general to the construction of mine props and, in particular, to a new and useful hydraulic mine prop in which a bottom ram portion has a piston end which is slidable in sealing engagement with a top cylindrical ram portion and which is movable in a pressure space which communicates through a pressure holding valve to a vent space defined between the valve and the upper portion of the upper ram cylinder and which maintains a pressure corresponding to the normal load.

DESCRIPTION OF THE PRIOR ART

The invention concerns a pressure holding valve device associated with mine props of a type described in DT-OS No. 2,101,475. Such pressure valves work satisfactorily when the pressure resting on the ram rises slowly over a long period of time. However, for suddenly and abruptly occurring rock bursts in the mine, these pressure holding valves are insufficiently effective because the pressure to be discharged suddenly in great quantity cannot be let out through the passages which are of too small cross-section. This results in high pressures occurring which cause a premature wearing of the construction elements and even a bulging, and possibly a bursting open, of the cylindrical part.

From German Patent DT-AS No. 1,078,516, a hydraulic mine ram is known which comprises in its upper ram portion, two parallelly connected overpressure valves which respond to pressures of different amounts. The valve having the larger cross-section responds upon the occurrence of a rock burst. In this mine ram, the upper ram is guided in piston fashion in the cylindrical bottom ram and rests on the pressure liquid cushion present below the piston. In the case of an occurrence of a rock burst in the mine, the pressure liquid to be let out as quickly as possible in relatively large quantity is conducted through a pipe extending through the piston up to the rock burst valve installed in the head of the upper ram and this occurs simultaneously with a braking action due to the multiple change of direction. This causes a sudden pressure increase when using only a pressure holding valve of the usual design and such would have the disadvantages of the valves described above.

SUMMARY OF THE INVENTION

The present invention provides a mine ram which responds in the case of a rock burst so as to displace the pressure liquid in a minimum of time so that no damage will occur to the hydraulic parts of the mine ram. In accordance with the invention, the mine ram comprises, beside the pressure holding valve which in itself is known, a rock burst valve. The rock burst valve is arranged in or parallel to the ram axis and includes an annular valve seat in the form of a shoulder formation formed at the bottom of a pot-type valve housing fixed in the upper part of the upper ram. The passage cross-section through the valve from the pressure space to a vent space and the cross-section of the inlet bore into the burst valve from the pressure space are at least of equal size and, preferably, of increasing size in the pressure release direction from the inlet bore into the valve through the passages to the vent space and out to the exterior of the valve.

The rapid emergence of the pressure liquid from the pressure zone in the case of a rock burst is advantageously furthered, according to the invention, by arranging the rock burst valve in or parallel to the ram axis and directly above the pressure zone and the pressure liquid, and the opening direction of the valve is opposed to the rock burst direction. In fact, with the sudden downward movement of the upper ram, the valve stem and the quantity of oil present at the cone of the rock burst valve move upwardly due to their mass inertia relative to the upper ram and contribute to the rapid opening of the valve and the removal of the pressure liquid, so that after completed pressure drop, the valve can be closed again extremely quickly.

Accordingly, it is an object of the invention to provide a hydraulic mine prop which includes a cylindrical ram top portion and a bottom ram portion telescopically engageable in the top ram portion and having an upper piston portion which is in sliding sealing engagement with the interior of the top ram portion and which also includes a ram head closing the top of the upper ram portion and a valve seat spaced downwardly from the head extending across the interior of the top ram portion and having a valve seat portion which is closable by a spring actuated valve. The passage into the seat portion and upwardly through the valve body to a vent space located between the head and the valve seat body is sufficiently large and located in an axial direction to permit a large discharge of the pressure from the pressure space into the vent space and out through openings in the top ram portion to the atmosphere.

A further object of the invention is to provide a hydraulic mine prop which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawing and descriptive matter in which there is illustrated a preferred embodiment of the invention.

DESCRIPTION OF THE PREFERRED EMBODIMENT

Figure 1:
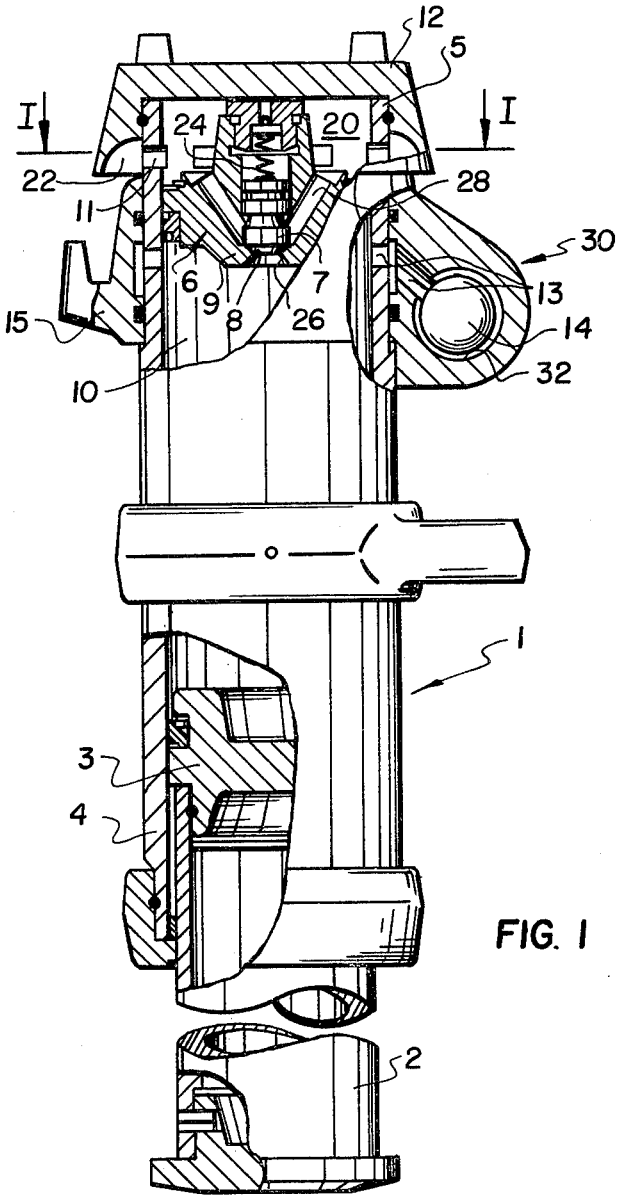
FIG. 1 is a partial side elevational, and partially broken-away axial sectional view of a mine prop constructed in accordance with the invention.
Figure 2:
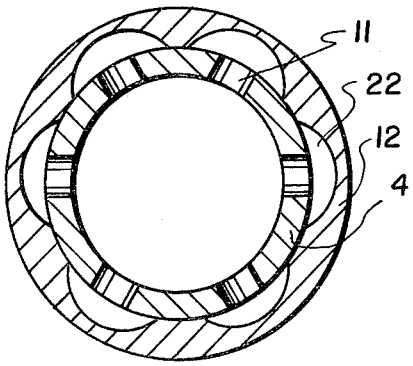
FIG. 2 is a section taken along the line I—I of FIG. 1.

Referring to the drawing in particular, the invention embodied therein, comprises a hydraulic mine ram or mine prop, generally designated 1, which includes a cylindrical bottom portion 2 which has a cylindrical piston 3 at its upper end which engages in sealing, sliding engagement with the interior wall of an upper ram portion 4. Upper ram portion 4 is closed at its upper or top end by a ram head 12. The upper ram portion includes one or more openings 11 for the venting of a vent space 20 defined between a valve body 6 and the ram head 12. The passages 11 open into a deflection passage 22 formed at the lower interior end of the ram head 12.

In accordance with the invention, a pot-type valve housing 6 comprises a valve seat body 9 which includes an annular seat or shoulder 8 which is normally closed by a rock burst valve body 7 which is urged against the seat by the force of a biasing spring 24. The valve housing 6 includes an inlet 26 from a pressure space 10 between valve body 6 and piston 3 which connects when valve 7 is lifted off the seat to one or more passages 28 which extend into the vent space 20.

A feature of the construction is that the shoulder 8 of the valve housing 6 is located in the bottom of the valve housing so that the pressure liquid is in direct contact with the valve body 7 which is biased onto the seat.

At an assumed rock burst which acts on the ram from the top downwardly, the valve body 7 and the pressurized liquid try, due to their inertia, to remain in their original positions so that, as the upper ram sinks in by the opening of the rock burst valve 7, counter to the spring biasing force by the spring 24. The increase of pressure in the pressure space 10 opens valve body 7 to permit an off-flow of the pressure liquid through the inlet 26 and the passages 28 to the vent space 20 and then through the openings 11 and the passage 22 to the atmosphere.

The cross-sections of the outlet passage 28 and the passage 11 and a deflection passage 22 are such that they are at least the size of the cross-section of the valve at the location of the seat 8 or they are larger in their successive order from the valve seat through the passage 28 to the passage 11 and the passage 22.

The ram shown in the invention operates with a holding valve, generally designated 30, which includes a globe valve 14 positioned in a cylindrical cavity 32 of a ring member 15 secured in position on the upper portion of the upper ram 4. The space within the globe valve 14 communicates through bores 13 to the pressure space 20. Such a pressure holding valve 30 is of conventional design.

While a specific embodiment of the invention has been shown and described in detail to illustrate the application of the principles of the invention, it will be understood that the invention may be embodied otherwise without departing from such principles.

What is claimed is:

1. A hydraulic mine prop, comprising a cylindrical top ram portion, a bottom ram portion telescopically engageable in said top ram portion and having an upper piston portion in sliding sealing engagement with the interior of said top ram portion, a ram head closing the top of said top ram portion, a valve seat body defined within said top ram portion adjacent said ram head extending across the interior of said top ram portion and having a valve seat portion and enclosing a vent space between said ram head and said valve seat body having an opening to atmosphere and also enclosing a pressure space between said valve seat body and said piston, an outlet passage extending through said valve seat body within said valve seat portion communicating said pressure space to said vent space, a valve member engageable with said valve seat portion to close said passage, spring means biasing said valve member into a closing position, said valve member being movable in an opposite direction against said spring means during a rock burst to open said passage sufficiently to permit outward flow of pressure from said pressure space through said valve seat body member and said passage, said valve seat body comprising a pot-type valve housing extending across the interior of said top ram portion adjacent the top thereof and having a central valve passage, said valve member being disposed in said passage above said valve seat, said pot-type valve housing also having at least one obliquely extending passage, defining said outlet passage, extending from said valve member obliquely upwardly into the space between said pot-type valve housing and the top of said top ram portion, said ram head having a skirt portion externally of said top ram portion and extending down and forming a venting air deflecting surface, and a vent opening in the wall of said top ram portion adjacent the upper end of said oblique passage in said pot-type valve housing in alignment with said skirt portion to direct air toward the air deflecting surface.

* * * * *